US007832246B2

(12) United States Patent
Spaans et al.

(10) Patent No.: US 7,832,246 B2
(45) Date of Patent: Nov. 16, 2010

(54) INSTALLATION FOR WINDING UP MATERIAL IN STRIP FORM

(75) Inventors: Johan Spaans, Noord-Scharwoude (NL); Hendrikus Wilhelmus Maria Olivier, Heerhugowaard (NL)

(73) Assignee: Tebulo Industrial Automation B.V., Alkmaar (NL)

( * ) Notice: Subject to any disclaimer, the term of this patent is extended or adjusted under 35 U.S.C. 154(b) by 658 days.

(21) Appl. No.: 11/522,373

(22) Filed: Sep. 18, 2006

(65) Prior Publication Data

US 2007/0063090 A1 Mar. 22, 2007

(30) Foreign Application Priority Data

Sep. 16, 2005 (EP) ..... 05108547

(51) Int. Cl.
*B21C 47/00* (2006.01)

(52) U.S. Cl. ..... 72/146

(58) Field of Classification Search ..... 72/146
See application file for complete search history.

(56) References Cited

U.S. PATENT DOCUMENTS 2,254,348 A * 9/1941 Bennewitz ..... 242/422.4
3,105,653 A * 10/1963 Beckwith ..... 242/470
3,698,223 A * 10/1972 Sagara ..... 72/146
4,437,223 A 3/1984 Petros et al.
6,401,582 B1 6/2002 Noe et al.

FOREIGN PATENT DOCUMENTS

| | | | |
|---|---|---|---|
| GB | 1339147 | * | 9/1971 |
| GB | 1 339 147 | | 11/1973 |
| GB | 2 023 532 | | 1/1980 |
| GB | 2 046 147 | | 11/1980 |
| WO | WO 2005039793 A2 | * | 5/2005 |

* cited by examiner

*Primary Examiner*—Dana Ross
*Assistant Examiner*—Matthew G Katcoff
(74) *Attorney, Agent, or Firm*—Young & Thompson

(57) ABSTRACT

An installation for processing material in strip form, such as a sealing strip that has been removed from a roll of material, comprises a rotary head, by means of which one end of the material in strip form can be grasped and on which said material in strip form can be wound, and guide means for guiding the material in strip form in the peripheral direction during winding. The guide means have a movable guide section that can be shifted between an open and a closed position, respectively, such that in the open position the wound-up material in strip found can be removed from the guide means.

22 Claims, 6 Drawing Sheets

INSTALLATION FOR WINDING UP MATERIAL IN STRIP FORM

FIELD OF THE INVENTION

The invention relates to an installation for processing material in strip form, such as a sealing strip that has been removed from a roll of material, comprising a rotary head, by means of which one end of the material in strip form can be grasped and on which said material in strip form can be wound, and guide means for guiding the material in strip form in the peripheral direction during winding.

BACKGROUND OF THE INVENTION

Such an installation is disclosed in British Patent Application 1 339 147. With this known installation a guide ring, which has flanges all round facing inwards, is provided around the rotary bead. The innermost edge of these flanges verges on the guide head. During winding, the material in strip form is guided between these flanges. As soon as the material in strip form has been completely wound up, the rotary head is withdrawn from the guide ring so that the material that has been wound up becomes accessible on the inside of the guide ring.

Although the material in strip form can be wound up in a controlled manner with such an installation, that is to say without the free end of the material in strip form flapping around in an uncontrolled manner, there are nevertheless disadvantages that can be pointed out. The most important disadvantage is that the removal thereof from wound-up material in strip form out of the guide ring is difficult. Specifically it must be taken into consideration that as soon as the winding movement is stopped, the elastic strip material will expand and tends to unwind to some extent. As a result the strip material becomes relatively firmly braced against the outside wall of the guide ring, which makes removal via the inside of the guide ring substantially more difficult.

SUMMARY OF THE INVENTION

The aim of the invention is, therefore, to provide an installation of the type described above that does not have this disadvantage or has this disadvantage to a much lesser extent, Said aim is achieved in that the guide means have a movable guide section that can be shifted between an open and a closed position, respectively, such that in the open position the wound-up material in strip form can be removed from the guide means.

With the installation according to the invention it is no longer necessary to remove the wound-up material in strip form by first moving this radially inwards from the guide means and then sliding it out of the guide means. As already mentioned above there are objections to such a procedure because the material in strip form has unwound to some extent in the meantime and has pressed against the peripheral boundary of the guide means.

With regard to the removal of the material in strip form, with the installation according to the invention it can suffice simply to open the movable guide section. After this guide section has been opened, the wound material in strip form can be pushed out of the guide. Even in the state in which the guide material in strip form has unwound again to some extent after winding up, such an operation can be carried out relatively easily.

The movable guide section can be arranged around the guide in many different locations. Said movable guide section can, for example, be constructed such that the wound material in strip form is pushed out of the guide in the axial direction and off the rotary head. However, an embodiment is preferred where, as is also the case in the installation according to the state of the art described above, guide means and a rotary head are provided that can be moved between a position in which they are axially offset with respect to one another and a position in which they overlap one another in the axial direction.

With this embodiment a first step in the release of the wound strip material is withdrawal of the rotary head from the guide means, such that the rotary head is also pulled out of the wound strip material. According to the invention with this arrangement provision can advantageously be made that the guide means at least have a peripheral boundary, which peripheral boundary can be shifted between a closed and an open position on at least one side with respect to the axis.

By providing the possibility for partially opening the peripheral boundary, the wound strip material can be pushed out of the guide means in the radial direction after the rotary head has been pulled back. With this variant as well it is advantageous that even wound strip material that has relaxed and unwound to some extent after winding can be pushed out without problems.

The section of the peripheral boundary that can be opened and closed can be constructed in many different ways. Said section of the peripheral boundary can, for example, be a closed wall section, However, a variant is preferred where the peripheral boundary at least partially comprises a series of pins positioned in parallel next to one another, the longitudinal direction of which is essentially parallel to the axis of the rotary head. In practice, such a discontinuous peripheral boundary section made up of pins acts in the same way as a closed wall section when guiding the material in strip form. However, a peripheral boundary section made up of pins has the major advantage that this can easily be moved away.

The latter can be achieved in that the pins can be moved essentially parallel to the axial direction of the rotary head to provide an open and closed position of the respective side. Furthermore, the peripheral boundary can have a fixed peripheral section. Said fixed peripheral section is opposite the side of the pins that can be shifted between an open and closed position. Furthermore, the peripheral boundary can have a movable wall section that can be moved transversely to the axis of the rotary head. By means of such a movable wall section, which can be moved radially, the wound material in strip form can be pressed flat, such that after removal from the installation it cannot unwind to give a loose strip that is difficult to handle.

With regard to pressing down the material in strip form the movable wall section can be at the free end of a pusher member. Said pusher member is then designed to compress the wound material in strip form against an opposing section of the peripheral boundary. In particular the pusher member can be designed to push the wound and optionally compressed material in strip form out of the guide means in the state in which the opposing section of the peripheral boundary has been opened.

Furthermore, the guide means can have guide walls that extend radially with respect to the axis of the rotary head, in which guide walls there is an opening through which the rotary head can be moved axially. In this case the peripheral boundary can extend transversely with respect to the at least one guide wall.

The guide wall can be fixed on a frame, with respect to which frame the rotary head is accommodated such that it can be moved. Preferably the rotary head can be moved on a carriage, the direction of movement of which is oriented transversely or perpendicularly to the surface of the guide wall. An electric motor and optionally a reduction gear unit can also be accommodated on this carriage for driving the rotary head.

Furthermore, the pins are preferably accommodated on a further carriage, the direction of movement of which is oriented perpendicularly to the surface of the guide wall, which guide wall is arranged between the two carriages. With this arrangement an auxiliary wall is provided that extends parallel to the guide wall, in which auxiliary wall there are openings for the pins.

The further carriage can also have pressing means for pressing the material in strip form in the direction towards the rotary head and guide wall. This guide wall can have a funnel-shaped transverse guide for centering the material in strip form with respect to the rotary head when it is pressed by the pressing means.

BRIEF DESCRIPTION OF THE DRAWINGS

The invention will now be explained in more detail with reference to an illustrative embodiment shown in the figures.

DETAILED DESCRIPTION OF EMBODIMENTS

Figure 1:
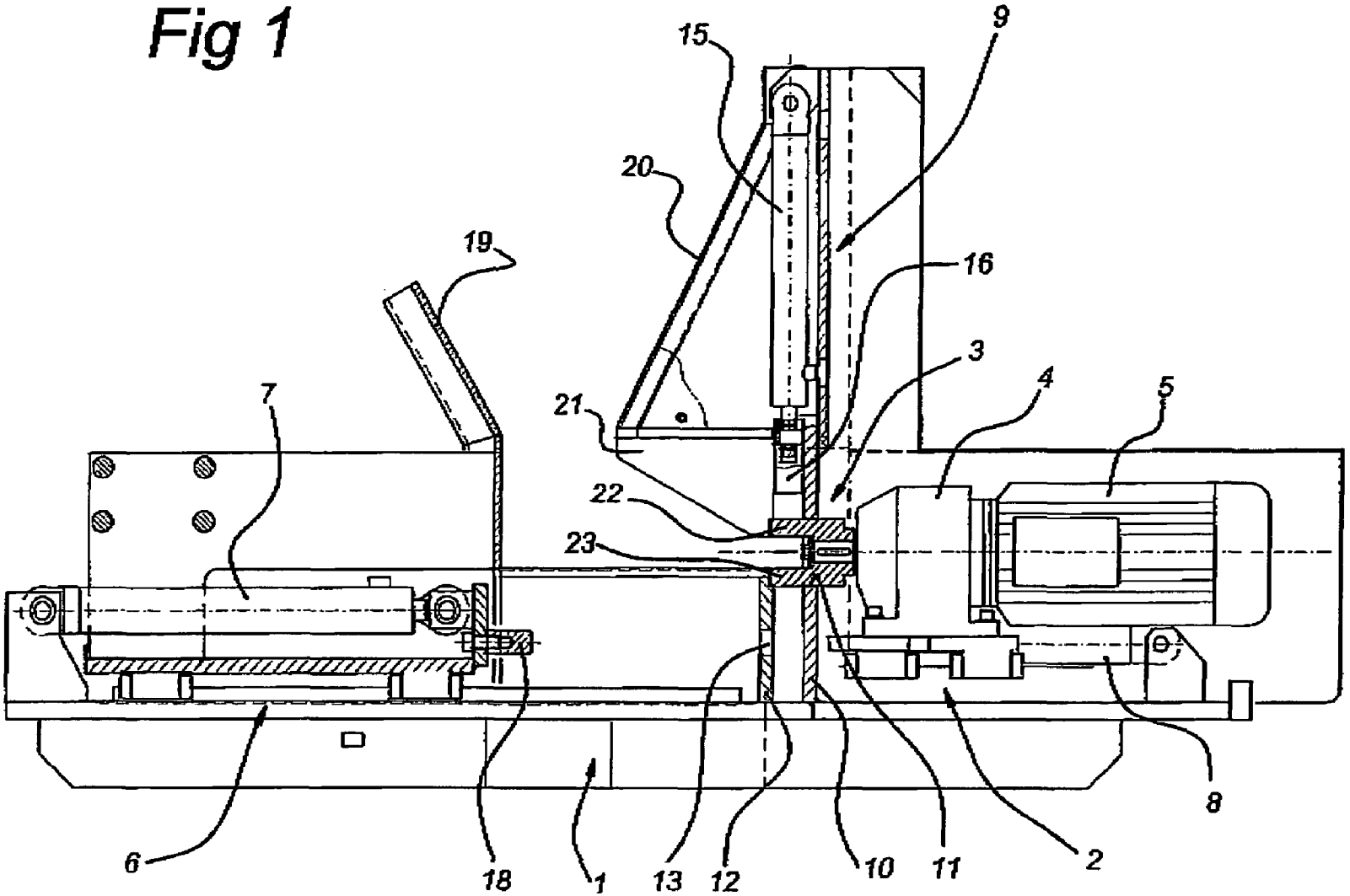
FIG. 1 shows a side view of the installation according to the invention.
Figure 2:
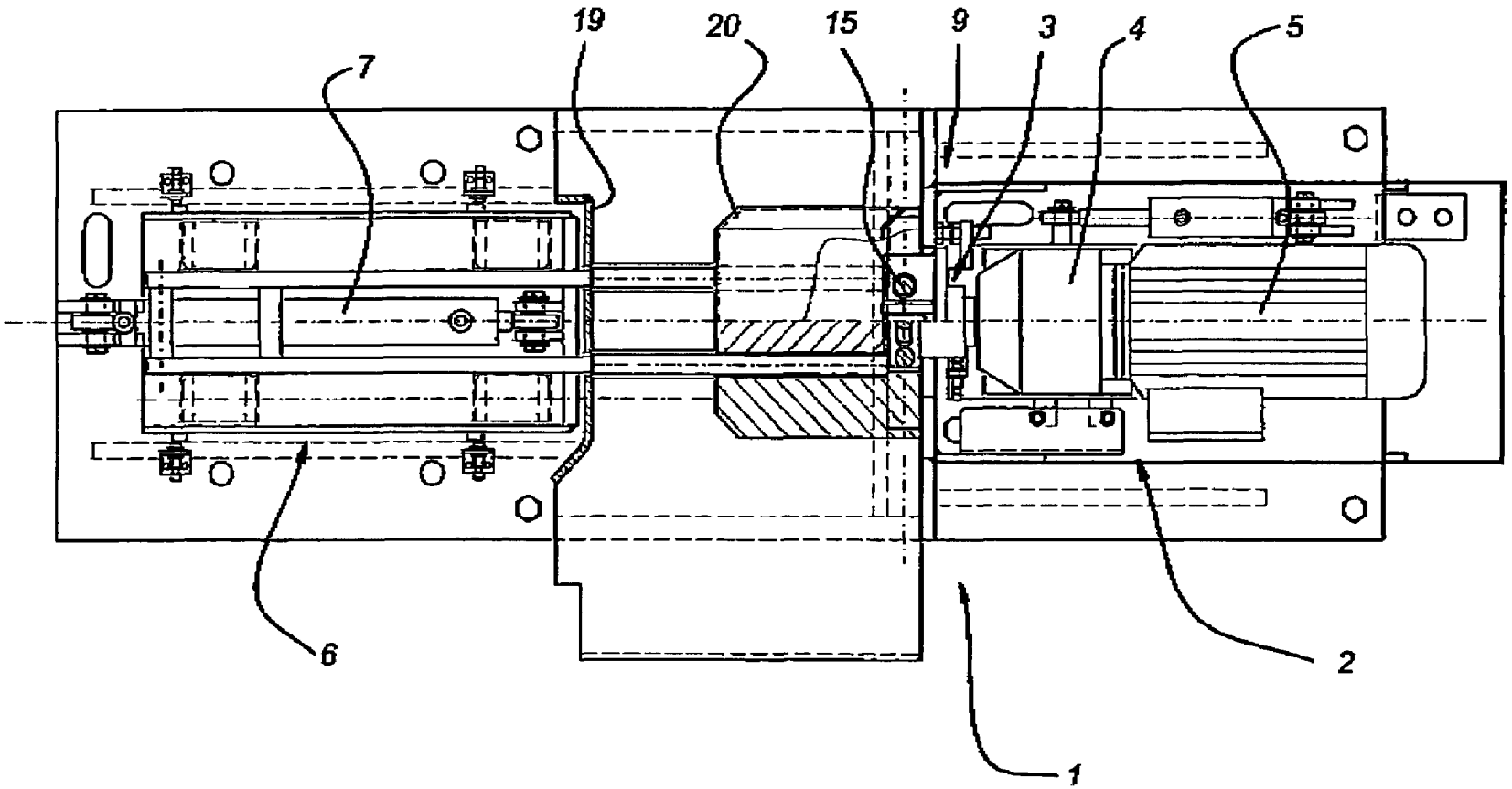
FIG. 2 shows a plan view.

The installation according to the invention shown in the FIGS. comprises a frame 1 on which a carriage 2 is mounted that supports a rotary head or winding mandrel 3. This winding mandrel is connected by means of a gearbox 4 to an electric motor 5. The rotary head 3 can be moved back and forth in the axial direction by means of the carriage 2. In the position shown in FIG. 1, the rotary head 3 is in the operating position.

The frame 1 also supports a further carriage 6, which can be driven by means of a hydraulic piston/cylinder device 7. This further carriage 6 is opposite the carriage 2 on which the rotary head 3 is located. The directions of movement of the two carriages 2, 6 are aligned with respect to one another.

The fame 1 also supports a further carriage 6, which can be driven by means of a hydraulic piston/cylinder device 7. This further carriage 6 is opposite the carriage 2 on which the rotary head 3 is located. The directions of movement of the two carriages 2, 7 are aligned with respect to one another, The frame indicated in its entirety by 9, which has, inter alia, a guide wall 10, is mounted in a fixed position on the frame 1. In this guide wall 10 there is a circular opening 11 through which the rotary head 3 has been inserted in the operating position shown in FIG. 1. There is an auxiliary wall 12 some distance away, parallel to the guide wall 10. A series of holes 13 have been made in this auxiliary wall 12, the function of which will be explained below.

Figure 3:
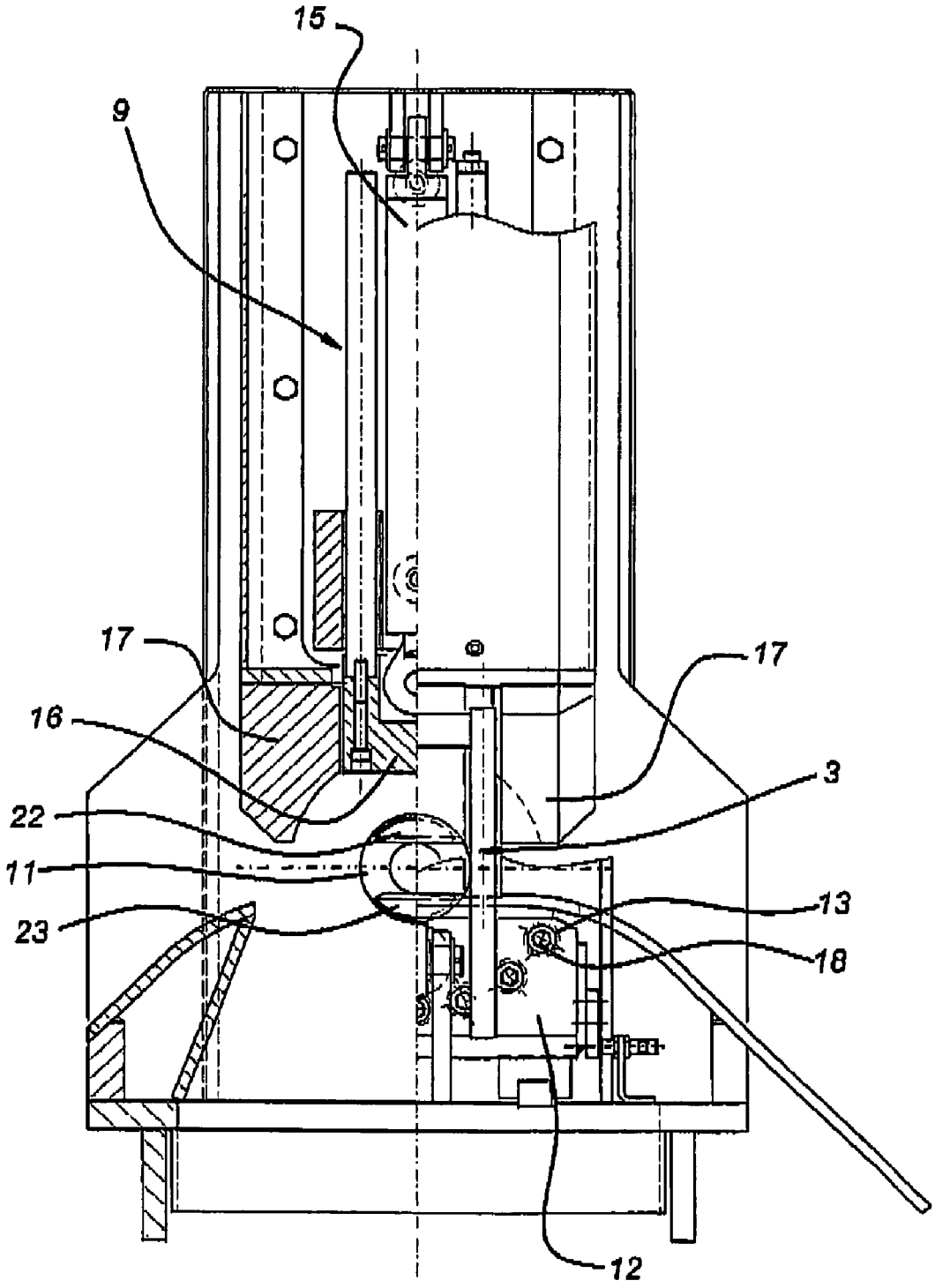
FIG. 3 shows a front view.

As shown FIGS. 1 and 3, there is a movable wall section 16 some distance above the rotary head 3. This movable wall section 16 can be moved up and down by means of the piston/cylinder device 15. The movable wall section 16 is accommodated between two fixed wall sections 17.

The further carriage 6 has a series of projections 18, each of which is aligned with respect to a hole 13 in the guide wall 12. A first input guide 19, which is in the form of a bent-back plate section, is mounted in a fixed position on the frame 1. In addition, a second input guide 20 is fixed to the frame 9. The two input guides 19, 20 together form a funnel, which facilitates the positioning of a piece of strip material in strip form in front of the rotary head 3. At the bottom of the second input guide 20 there is also a nose 21, which ensures that the strip of strip material can be pushed into the rotary head 3.

Figure 4:
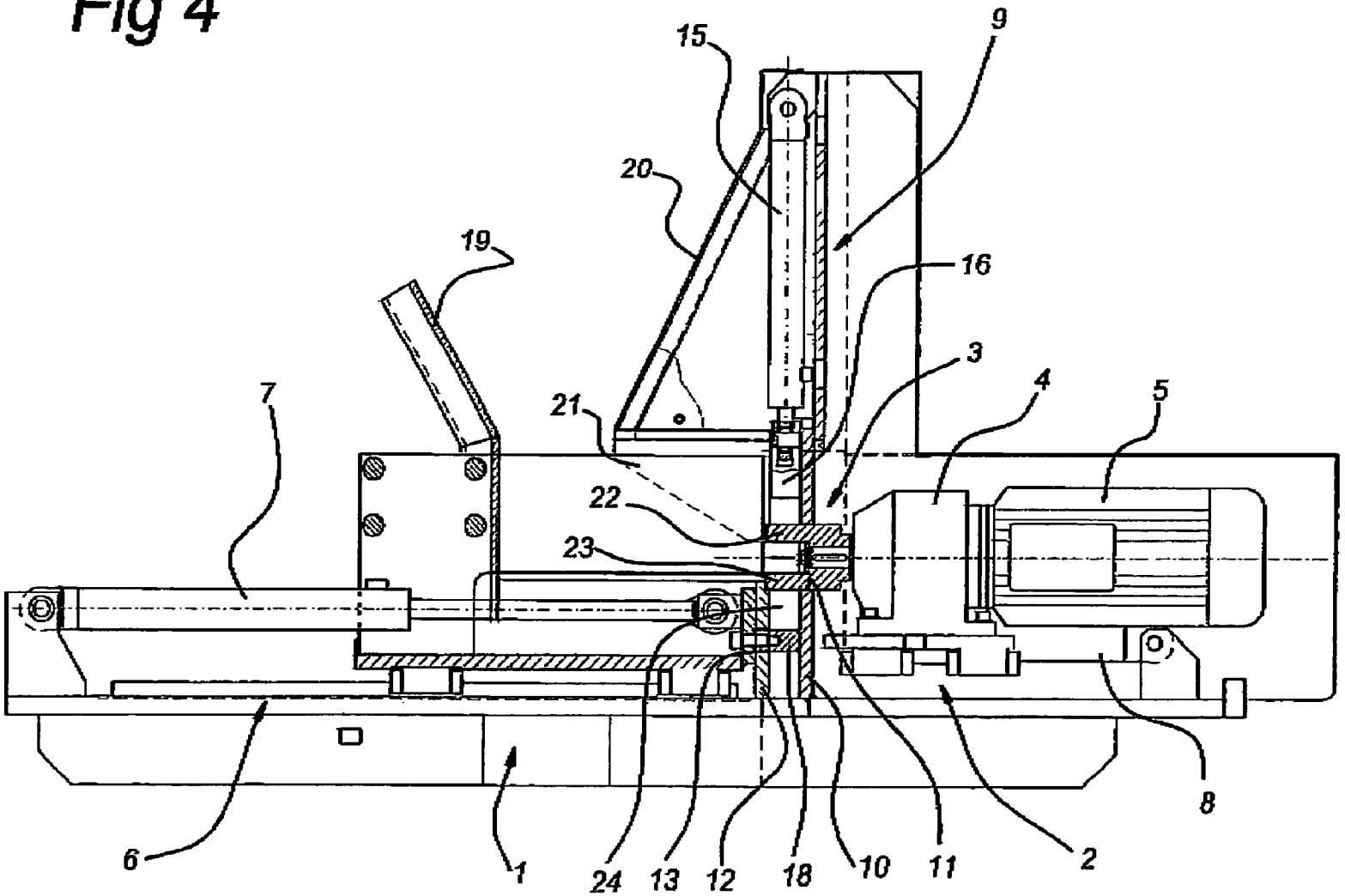
FIGS. 4 to 6 show various stages in the operation of the installation
Figure 5:
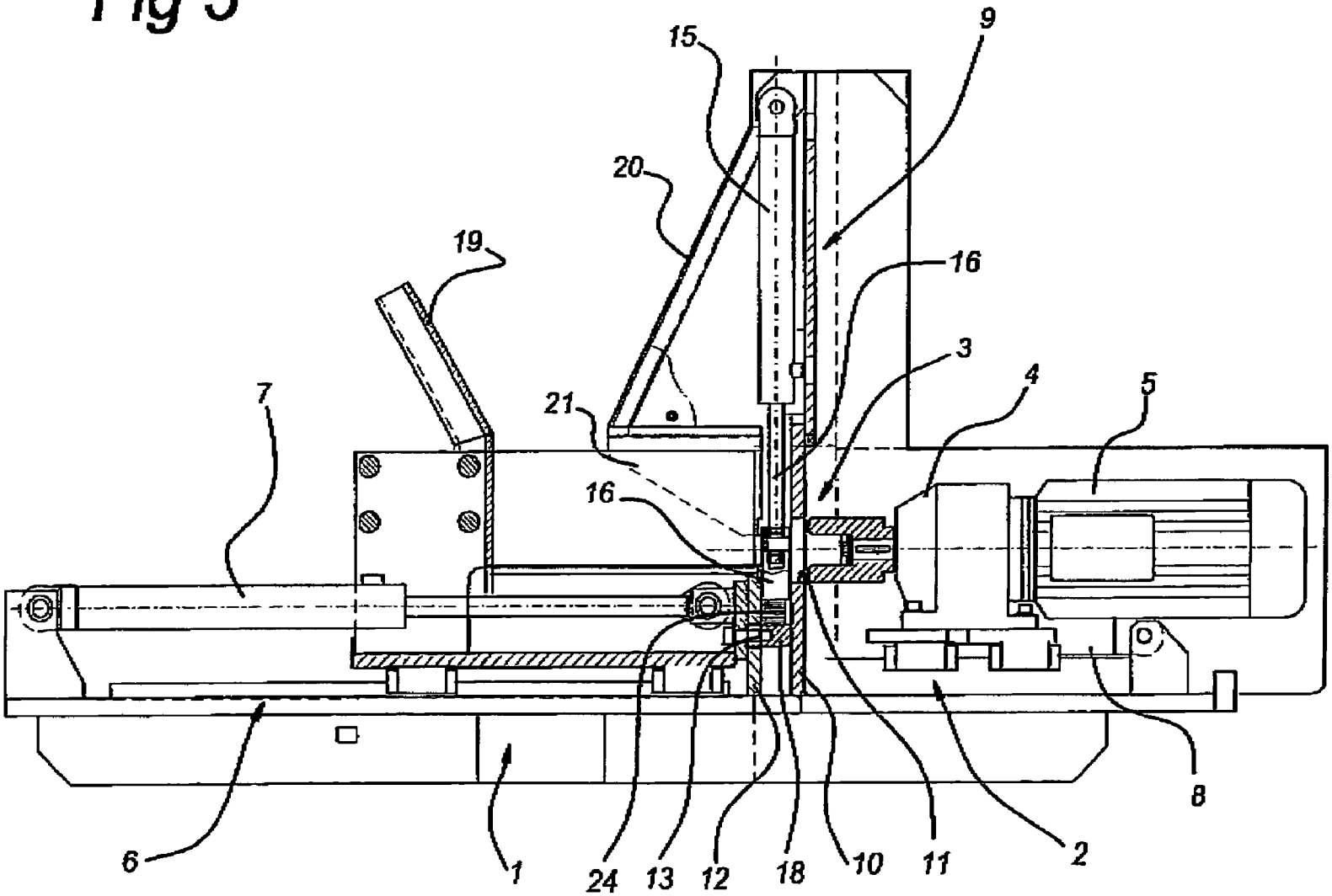
Figure 6:
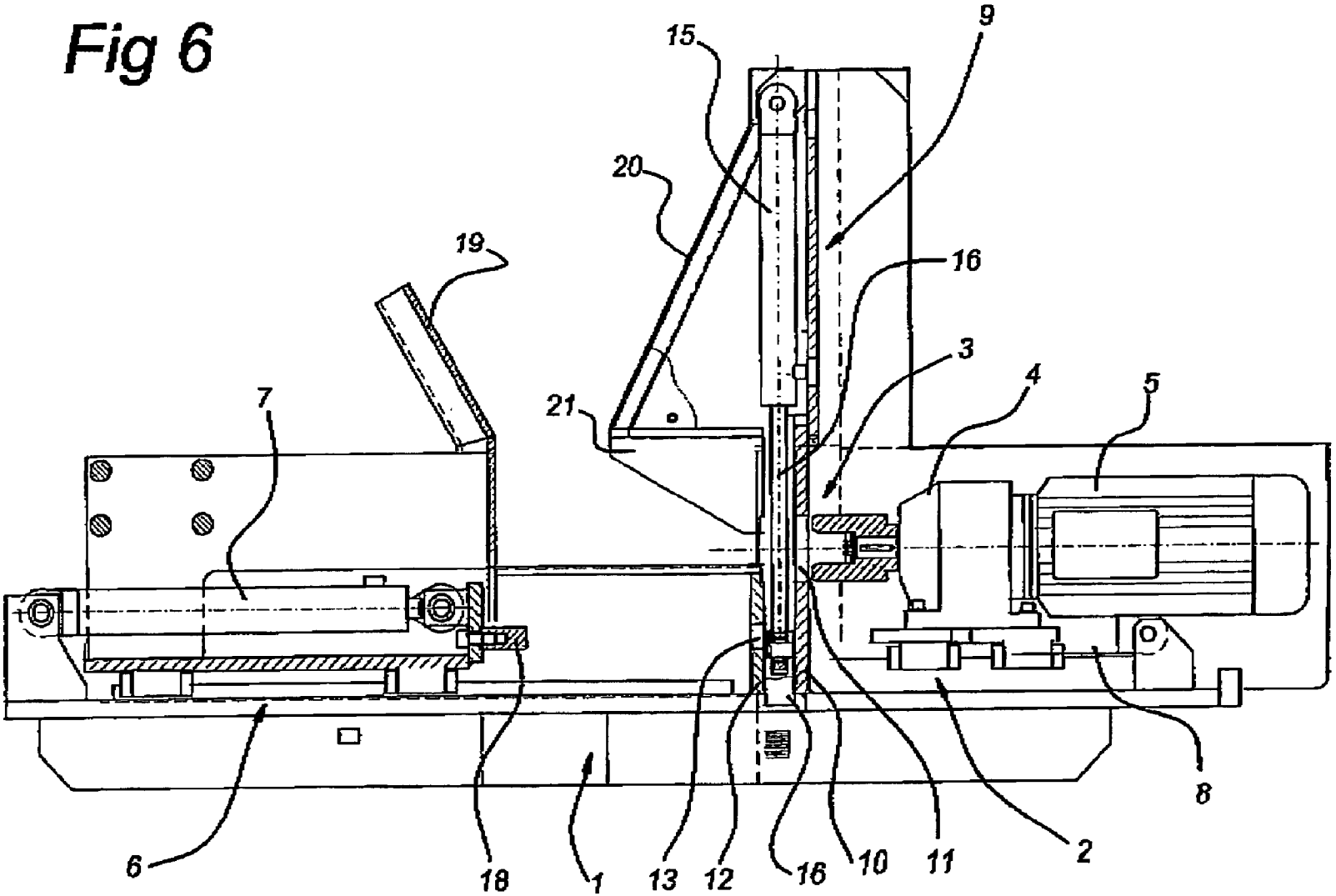

The operation of the installation described above will now be explained in more detail with reference to the steps shown in FIGS. 4 to 6. After a piece of strip material in strip form has been brought in front of the rotary head 3 in the manner described above, this is pushed between the jaws 22, 23 thereof. The rotary head 3 is then made to rotate and the strip material in strip form is wound onto the rotary head. During this operation the strip material is guided in the chamber 24, which, as shown in FIG. 4, is delimited by the guide wall 10, the auxiliary wall 12, the fixed and movable wall sections 17, 16 and by the projections 18. For this purpose these projections 18 are inserted through the holes 13 in the second fixed guide wall 12 when the further carriage 6 is moved forwards.

After the strip material in strip form has been wound up in this way, this must be removed from the installation. For this purpose, first of all, as shown in FIG. 5, the carriage 2 is moved back, as a result of which the rotary head 3 is removed from the chamber 24. During this operation the rotary head 3 is completely withdrawn from the hole 11 in the guide wall 10. The hydraulic piston/cylinder device 15 is then actuated, as a result of which the movable wall section 16 is moved downwards in the direction of the projections 18. On continuation of this movement, the wound strip material in strip form is pressed against the projections 18 to an ever increasing extent, as a result of which this acquires a flattened form. In this flattened form there is no longer the risk that the wound form is lost once the winding has been removed from installation.

After the winding has been flattened in this way, the further carriage 7 is also pulled back, with the result that the projections 18 are withdrawn from the holes 13 in the auxiliary wall 12. The chamber 24 is then no longer delimited towards the bottom, such that on further actuation of the hydraulic piston/cylinder device 15 the flattened winding of strip material in strip form can be pushed out. The movable wall section 16 can then be retracted. The cycle for the processing of a piece of strip material in strip form is thus complete.

The invention claimed is:

1. An installation for processing material in strip form, comprising:

a rotary head having an axial direction that is oriented according to a rotary axis, said rotary head being configured to grasp one end of the material in strip form, said rotary head being configured to wind said material in strip form thereon, and guide walls delimiting a chamber for guiding the material in strip form in a peripheral direction during winding, wherein at least two opposing said guide walls delimit the chamber externally when viewed from a radial direction which is transverse to said axial direction, and wherein the guide walls have a movable guide section configured to be shifted in said axial direction between an open and a closed position, respectively, such that in the closed position, said movable guide section forms one of the guide walls of the chamber and in the open position said movable guide section is moved away from all other guide walls such that said chamber is no longer delimited towards the bottom, and said movable guide section is positioned away from said chamber so that wound-up material in strip form can be removed from the chamber.

2. The installation according to claim 1, wherein said guide walls and said rotary head can be moved between a position in which they are axially spaced apart with respect to one another and a position in which they overlap one another in the axial direction, and wherein the guide walls at least have a peripheral boundary wall, said peripheral boundary wall can be shifted between a closed and an open position on at least one side with respect to the axis of the rotary head.

3. The installation according to claim 2, wherein the peripheral boundary wall at least partially comprises said movable guide section, said movable guide section includes a series of pins positioned next to one another.

4. The installation according to claim 3, wherein a longitudinal direction of the pins is essentially parallel to the axis of the rotary head.

5. The installation according to claim 3, wherein the pins can be moved essentially parallel to the axial direction of the rotary head to provide said open and closed position of the movable guide section.

6. The installation according to claim 2, wherein the peripheral boundary wall at least partially has a fixed peripheral wall section.

7. The installation according to claim 6, wherein the fixed peripheral wall section is opposite the side of the peripheral boundary wall that can be shifted between an open and closed position.

8. The installation according to claim 2, wherein the peripheral boundary wall has a movable wall section that can be moved transversely to the axis of the rotary head.

9. The installation according to claim 8, wherein the movable wall section is at a free end of a pusher member.

10. The installation according to claim 9, wherein the pusher member is designed to compress the wound material in strip form against an opposing section of the peripheral boundary wall.

11. The installation according to claim 8, wherein the movable wall section is designed to push the wound-up and optionally compressed material in strip form out of the guide walls in a state in which the opposing section of the peripheral boundary wall has been opened.

12. The installation according to claim 7, wherein the movable wall section is adjacent to the fixed peripheral wall section.

13. The installation according to claim 12, wherein the movable wall section is accommodated between two fixed peripheral wall sections.

14. The installation according to claim 1, wherein the guide walls have at least one radial guide wall extending radially with respect to the axis of the rotary head, in said at least one radial guide wall there is an opening through which the rotary head can be moved axially.

15. The installation according claim 14, wherein the peripheral boundary wall extends transversely with respect to the at least one radial guide wall.

16. The installation according to claim 14, wherein the at least one radial guide wall is fixed to a frame, with respect to said frame the rotary head is accommodated such that said rotary head can be moved.

17. The installation according to claim 16, wherein the rotary head can be moved on a carriage, a direction of movement of said carriage is oriented transversely or perpendicularly to a surface of the radial guide wall.

18. The installation according to claim 17, wherein the rotary head is connected to an electric motor and optionally a reduction gear unit, which are accommodated on the carriage.

19. The installation according to claim 17, wherein said guide walls and said rotary head can be moved between a position in which they are axially spaced apart with respect to one another and a position in which they overlap one another in the axial direction, wherein the guide walls at least have a peripheral boundary wall, said peripheral boundary wall can be shifted between a closed and an open position on at least one side with respect to the axis of the rotary head, the peripheral boundary wall at least partially comprising a series of pins positioned next to one another, and the longitudinal direction of the pins being essentially parallel to the axis of the rotary head, wherein the pins are accommodated on a further carriage, a direction of movement of said further carriage is oriented perpendicularly to the surface of the radial guide wall, said radial guide wall is arranged between said carriage and said further carriage.

20. The installation according to claim 19, wherein an auxiliary wall is provided that extends parallel to the radial guide wall, in said auxiliary wall there are openings for the pins.

21. The installation according to claim 19, wherein the further carriage has pressing means for pressing the material in strip form in the direction towards the rotary head and said radial guide wall.

22. The installation according to claim 21, wherein the radial guide wall has a funnel-shaped transverse guide for centering the material in strip form with respect to the rotary head when the material in strip form is pressed by the pressing means.

* * * * *